US006367118B1

(12) United States Patent
Berfield

(10) Patent No.: US 6,367,118 B1
(45) Date of Patent: Apr. 9, 2002

(54) VACUUM CLEANER HOSE CLIP

(75) Inventor: Robert C. Berfield, Jersey Shore, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/733,489

(22) Filed: Dec. 8, 2000

(51) Int. Cl.[7] ..... A47L 9/00; A44B 21/00

(52) U.S. Cl. ..... 15/323; 15/339; 24/16 R; 24/339; 248/75

(58) Field of Search ..... 15/323, 339; 24/16 R, 24/336, 339, 67 R, 533, 562; 138/112; 248/75, 74.2

(56) References Cited

U.S. PATENT DOCUMENTS

| | | | | | |
|---|---|---|---|---|---|
| 1,816,301 | A | * | 7/1931 | Sundell | 24/339 |
| 1,959,633 | A | | 5/1934 | Madden | |
| 2,942,314 | A | | 6/1960 | Debner et al. | |
| 3,033,412 | A | | 5/1962 | Fox | |
| 3,206,086 | A | | 9/1965 | Duffney | |
| 3,483,996 | A | | 12/1969 | Scammon | |
| 3,543,355 | A | | 12/1970 | Wyckoff et al. | |
| 3,636,595 | A | | 1/1972 | Wines | |
| 3,979,096 | A | * | 9/1976 | Zieger | 248/75 |
| 3,996,641 | A | * | 12/1976 | Eichholz | 15/339 |
| 4,292,749 | A | | 10/1981 | Thomas | |
| 4,407,472 | A | * | 10/1983 | Beck | 248/339 X |
| 4,563,789 | A | * | 1/1986 | Berfield | 15/339 X |
| 4,837,899 | A | | 6/1989 | Young | |
| 5,079,802 | A | * | 1/1992 | Blase et al. | 24/16 R |
| 6,109,569 | A | * | 8/2000 | Sakaida | 248/75 |

FOREIGN PATENT DOCUMENTS

| | | |
|---|---|---|
| CH | 280413 | 4/1952 |
| DE | 702098 | 1/1941 |
| IN | 16287 | 6/1930 |

* cited by examiner

*Primary Examiner*—Chris K. Moore
(74) *Attorney, Agent, or Firm*—Marshall, Gerstein & Borun

(57) ABSTRACT

A vacuum cleaner hose clip is disclosed. The vacuum cleaner hose clip includes a first curvilinear arm adapted to wrap partially around a portion of a vacuum cleaner hose, and a second curvilinear arm adapted to wrap completely around a second portion of a vacuum cleaner hose to hold the vacuum cleaner hose portions together. The clip further includes a locking mechanism to secure the second curvilinear arm in position around the vacuum hose.

27 Claims, 2 Drawing Sheets

VACUUM CLEANER HOSE CLIP

FIELD OF THE INVENTION

The invention generally relates to vacuum cleaners and, more particularly, relates to apparatus for maintaining and storing vacuum cleaner hoses.

BACKGROUND OF THE INVENTION

Many vacuum cleaners include flexible hoses which enable a user to reach numerous locations without moving the entire vacuum. For example, in a typical canister type of household vacuum cleaner, the flexible hose may be attached to a swivel coupling provided at the top of the canister to enable the hose to rotate and reach numerous locations. When the user has completed using the vacuum cleaner, the cleaner is typically then placed in a closet or other suitable storage space with the vacuum cleaner hose simply being haphazardly placed in with the vacuum cleaner.

However, with wet/dry vacuum cleaners, the vacuum cleaner often remains within a given work space, such as a shop floor or the like. While such units typically include wheels or caster feet to enable the vacuum cleaner to be moved, the vacuum cleaner hose typically remains attached to the wet/dry vacuum cleaner and does not lend itself to tidy and concise storage. As a result, the hose either remains attached to the vacuum cleaner and occupies space on the shop floor in an unorganized and potentially unsafe manner or else the user is forced to create an independent solution such as tying the hose together with external fasteners or removing the hose from the cleaner and storing it separately.

U.S. Pat. No. 4,837,899 discloses one attempt at a mechanism enabling a vacuum cleaner hose to be clipped together. The clip includes first and second substantially c-shaped sections connected in mirror image relationship to one another. However, the two substantially c-shaped sections provide relatively large, opposed, inlets for receipt of the vacuum hose. As a result, forces imparted to one and/or both of the hoses in a direction parallel to a longitudinal axis cutting through the hose clip can cause one or both of the hoses to be removed from the clip. This not only can result in the hose becoming loose, but can also tend to cause the clip to be lost as it is removed from the hose.

SUMMARY OF THE INVENTION

In accordance with one aspect of the invention, a vacuum cleaner hose clip is provided which comprises a first curvilinear member having first and second ends, a bridge having first and second ends, and a second curvilinear member having first and second ends. The bridge first end is connected to the second end of the first curvilinear member. The first end of the second curvilinear member is connected to the second end of the bridge. The second curvilinear member is adapted to move from a release position wherein the second end of the second curvilinear member is spaced apart from the bridge to a locking position wherein the second end of the second curvilinear member is engaging the bridge.

In accordance with another aspect of the invention, a vacuum cleaner hose clip adapted to hold first and second vacuum cleaner hose portions together is provided which comprises a first arm and a second arm. The first arm forms an incomplete loop and is adapted to partially surround a first hose portion. The second arm is connected to the first arm and forms an incomplete loop. The second arm is adapted to partially surround a second hose portion. The first and second arms form a substantially s-shaped hose clip.

In accordance with another aspect of the invention, a wet/dry vacuum cleaner is provided which comprises a tank, a vacuum source associated with the tank, a hose connected to an inlet of the vacuum source, and a hose clip connected to the hose. The vacuum hose is adapted to draw matter into the tank. The hose clip includes first and second arms wherein the first arm wraps around the entire circumference of the hose, and the second arm is partially wrapped around the circumference of the hose.

These and other aspects and features of the invention will become more apparent from the following detailed description when taken in conjunction with the accompanying drawings.

Figure 1:
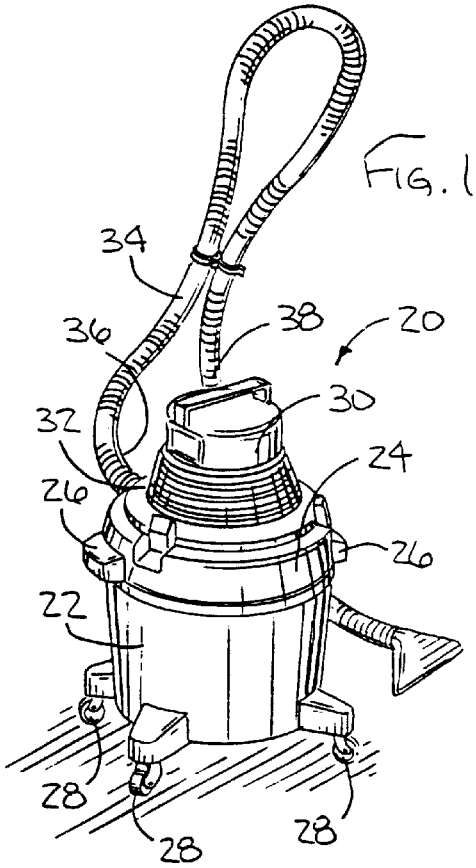
FIG. 1 is an isometric view of a vacuum cleaner constructed in accordance with the teachings of the invention.

While the invention is susceptible to various modifications and alternative constructions, certain illustrative embodiments thereof have been shown in the drawings and will be described below in detail. It is to understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Referring now to the drawings, and with specific reference to FIG. 1, a vacuum cleaner constructed in accordance with the teachings of the invention is generally depicted by reference numeral 20. While the vacuum cleaner 20 depicted is in the form of a wet/dry vacuum cleaner, it is to be understood that other types of vacuum cleaners may be constructed in accordance with the teachings of the invention, including household canister and hand-held vacuums.

As shown in FIG. 1, the vacuum cleaner 20 includes the tank 22 to which a lid 24 is removably attached. The lid includes handles 26 to facilitate lifting of the vacuum cleaner 20 as well as removal of the lid 24 when disposal at the contents of the tank 22 is desired. Casters 28 are attached to tank 22 to allow the vacuum cleaner 20 to be easily moved about a worksite.

A vacuum source 30 is mounted within the lid 24 and includes an inlet 32 for receipt of debris, as well as an outlet (not shown) in fluid communication with the tank 22. A flexible vacuum hose 34 includes an outlet 36 connected to the inlet 32 of the vacuum source 30, as well as an inlet 38 which is adapted to mate with various vacuum tools such as nozzles and brushes (not shown). U.S. Pat. No. 6,009,596, assigned to the present assignee and expressly incorporated herein by reference, discloses one example of a wet/dry vacuum cleaner.

Figure 2:
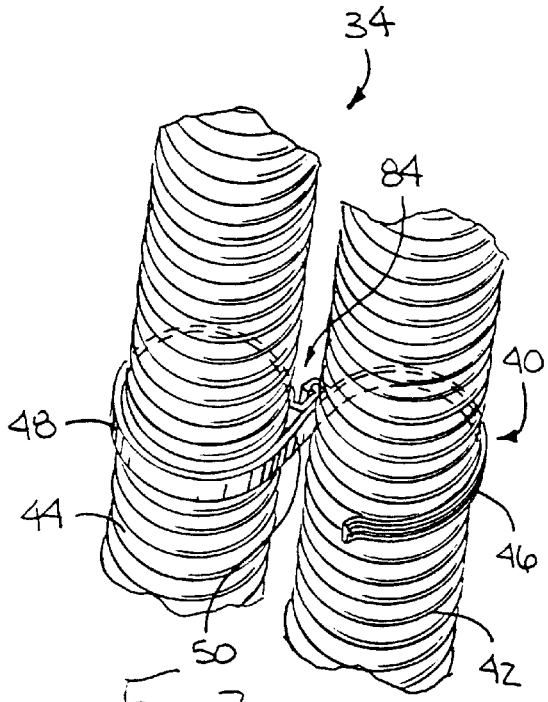
FIG. 2 is an isometric, fragmentary, view of portions of a vacuum cleaner hose connected by a hose clip constructed in accordance with the teachings of the invention.

Referring now to FIG. 2, a section of the vacuum hose 34 depicted in FIG. 1 is shown in detail with a hose clip 40 connecting a first portion 42 of the vacuum hose 34 to a second portion 44 of the vacuum hose 34 in a concise arrangement. As a result, the vacuum hose 34 can remain attached to the vacuum 20, but in a concise and out-of-the-way manner.

Figure 3:
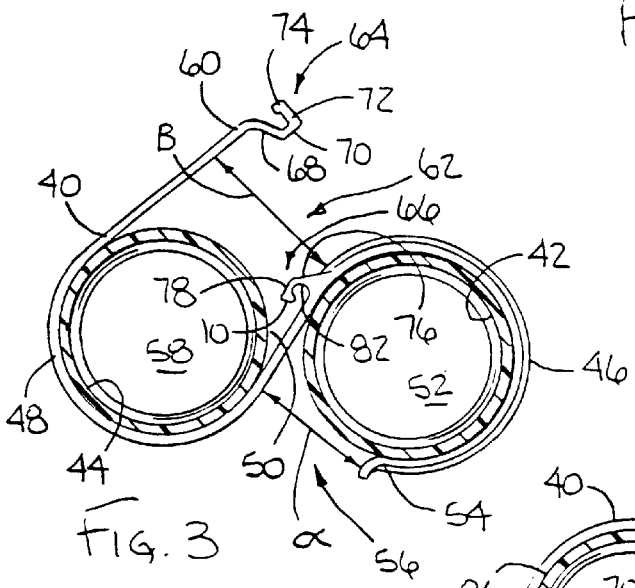
FIG. 3 is a side view of a hose clip constructed in accordance with the teachings of the invention and depicted in a release position.
Figure 4:
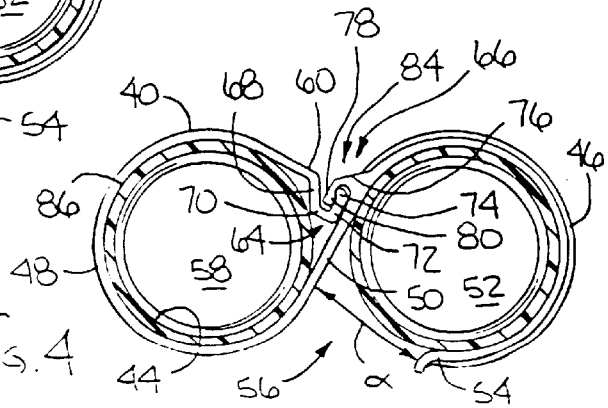
FIG. 4 is a side view of the hose clip of FIG. 3, but depicted in a locking position.

The hose clip 40 is adapted to move from a release position depicted in FIG. 3, to a locking position as depicted in FIG. 4. The release position enables the second portion 44 of the vacuum hose 34 to be removed from the hose clip 40, while the locking position enables the second portion 44 of the hose clip 40 to be maintained on the hose clip 34.

More specifically, the hose clip 40 includes a first curvilinear arm 46 connected to a second curvilinear arm 48. An expanse of material between the first curvilinear arm 46 and second curvilinear arm 48 forms a bridge 50. The first curvilinear arm 46 forms a partial loop defining an inlet space 52. A first end 54 of the first curvilinear arm 46 is spaced away from the bridge 50 a distance $\alpha$, thereby forming an entryway 56 to the inlet space 52.

In regard to the second curvilinear arm 48, as shown in FIGS. 3 and 4, it is adapted to either form a continuous loop (FIG. 4), or a partial loop (FIG. 3). In either position, the second curvilinear arm 48 forms an inlet space 58. In the release position, a second end 60 of the second curvilinear arm 48 is spaced away from the bridge 50 a distance $\beta$, thereby forming an entryway 62 to the inlet space 58.

The second end 60 of the second curvilinear arm 48 terminates in a hook 64 adapted to mate with a clasp 66 attached to the bridge 50. The hook 64 includes a ledge 68, a wall 70 and a lip 72. The lip 72 terminates in a increased thickness detent 74. The clasp 66 includes a canted wall 76, as well as a leg 78 terminating in a increased thickness detent 80. As shown in FIG. 4, when the hook 64 mates with the clasp 66, the increased thickness detent 74 flexes the leg 78 away from the bridge 50 sufficiently to allow the detent 74 to pass by the detent 80 and into a socket 82 to frictionally secure the hook 64 to a clasp 66. The hook 64 and clasp 66 therefore form a locking assembly 84. In alternative embodiments, other forms of retainers are possible to connect the arm 48 to the bridge 50.

In operation, the second curvilinear arm 48 is primarily designed to remain attached completely around a circumference 86 of a vacuum hose 34. In so doing, the likelihood of hose clip 40 being lost is lessened. Conversely, the first arm 46 is adapted to allow the vacuum hose 34 to be removed therefrom when the vacuum cleaner 20 is in use, and allow the vacuum hose 34 to be easily reinserted when storage of the vacuum hose 34 is desired. To facilitate this action, the hose clip 40 is preferably manufactured from a resilient material such as plastic to enable the first and second arms 46 and 48 to easily deflect.

Since the second curvilinear arm 48 is designed to wrap completely around the circumference 86 of the vacuum hose 34, and the entry way 56 to inlet space 52 is provided substantially orthogonal to the bridge 50, the clip 40 has greater ability, as opposed to prior art mechanisms, to withstand forces tending to pull the hose clip portions 42 and 44 apart in a direction parallel to a longitudinal axis A passing through the clip 40.

Figure 5:
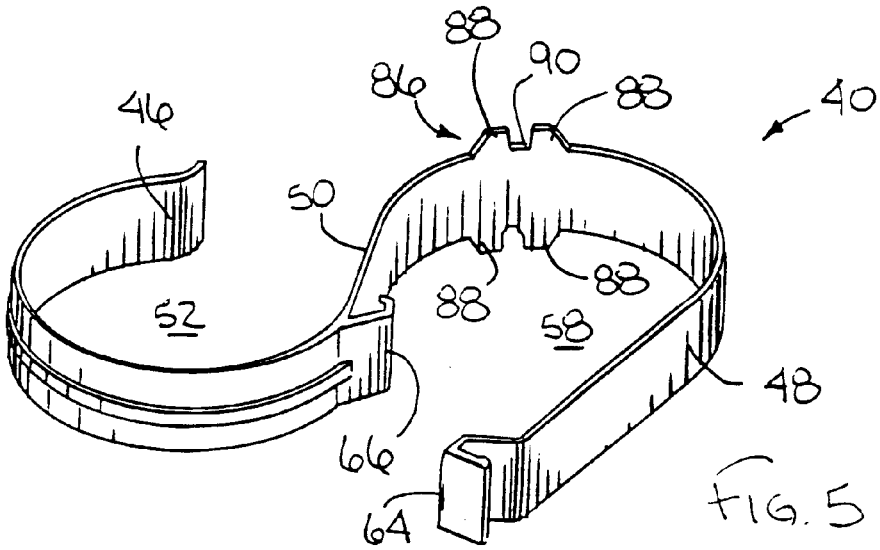
FIG. 5 is an isometric view of a second embodiment of a hose clip constructed in accordance with the teachings of the invention.

FIG. 5 depicts an alternative embodiment of the hose clip 40 constructed in accordance with the teachings of the invention. The hose clip 40 is similar to the aforementioned embodiment but additionally includes brackets 86 to facilitate attachment of the hose clip 40 to a wall, table, or the like. In so doing the hose 34 can be removed from the vacuum cleaner 20 and conveniently stored separately.

As depicted, the brackets 86 laterally flank the second curvilinear arm 48, although the brackets 86, or other mechanism for attaching the hose clip to a surface, can be located in a different location on the hose clip 40 including, but not limited to, the first curvilinear arm 46. Each bracket 86 includes first and second extensions 88 spaced by a recess 90. The recess 90 is sized so as to allow a fastener, such as a screw or nail (not shown), to extend therethrough. When mounted to a wall or the like, the heads of the fasteners would engage the brackets 86 and sandwich the brackets 86 between the fastener heads and the surface to which the hose clip 40 is attached. In alternative embodiments, the clip 40 may include other mechanisms for fastening the clip 40 to a surface including, but not limited to, an aperture formed directly in the bridge 50.

Figure 6:
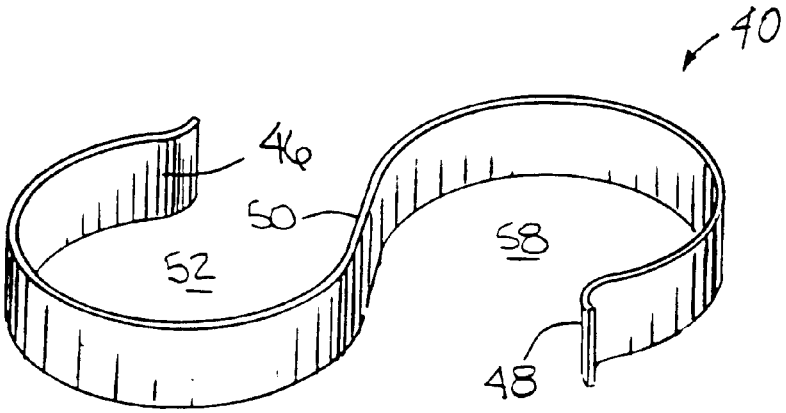
FIG. 6 is an isometric view of a third embodiment of a hose clip constructed in accordance with the teachings of the invention.

FIG. 6 depicts a third embodiment of a hose clip constructed in accordance with the invention. The hose clip 40 is similar in many respects to the first two embodiments and wherein like elements are employed, like reference numerals are used. A difference with the third embodiment is that both arms 46, 48 are configured to form partial loops. A hook 64 and clasp 66 arrangement are not provided.

Figure 7:
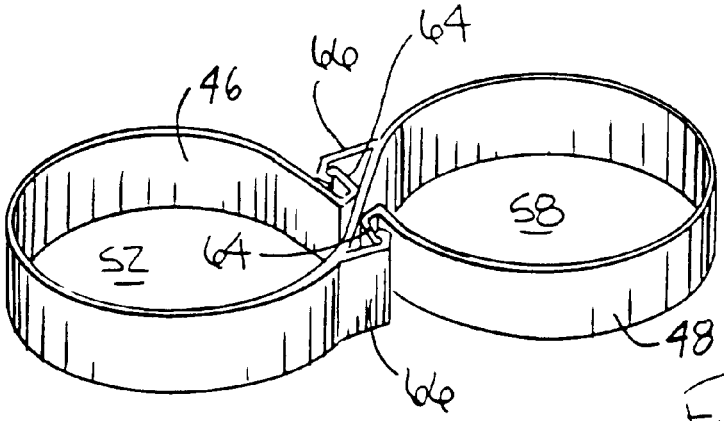
FIG. 7 is an isometric view of a fourth embodiment of a hose clip constructed in accordance with the teachings of the invention.

FIG. 7 depicts a fourth embodiment of a hose clip constructed in accordance with the invention. The hose clip 40 is similar in many respects to the first three embodiments and wherein like elements are employed, like reference numerals are used. A difference with the fourth embodiment is that both arms 46, 48 are configured to form a complete loop adapted to completely surround a hose. First and second sets of hooks 64 and clasps 66 are provided.

From the foregoing, one skilled in the art will recognize that the invention provides an apparatus which enables vacuum hose portions to be readily and neatly stored, with greater ability to withstand forces tending to pull the hoses apart.

What is claimed is:

1. A vacuum cleaner hose clip, comprising:

a first curvilinear member having first and second ends;

a bridge having first and second ends, the bridge first end being connected to the second end of the first curvilinear member; and a second curvilinear member having first and second ends, the first end of the second curvilinear member being connected to the second end of the bridge, the second curvilinear member being adapted to move from a release position wherein the second end of the second curvilinear member is spaced apart from the bridge, to a locking position wherein the second end of the second curvilinear member is engaging the bridge.

2. The vacuum cleaner hose clip of claim 1, wherein the first curvilinear member, bridge, and second curvilinear members are formed from a unitary piece of material.

3. The vacuum cleaner hose clip of claim 2, wherein the unitary piece of material is formed from plastic.

4. The vacuum cleaner hose clip of claim 1, wherein the clip has the shape of an "S" when the second end of the second curvilinear member is in the release position.

5. The vacuum cleaner hose clip of claim 1, further including a lock, the lock being operatively associated with the second end of the second curvilinear member and the bridge to maintain the second curvilinear member in the locking position.

6. The vacuum cleaner hose clip of claim 5, further including a second lock, the second lock being operatively associated with the first end of the first curvilinear member and the bridge to maintain the first curvilinear member in a locking position forming a complete loop.

7. The vacuum cleaner clip of claim 5, wherein the lock includes a hook attached to the second end of the second curvilinear member and a clasp attached to the bridge, the hook and the clasp being adapted to matingly connect.

8. The vacuum cleaner clip of claim 5, wherein the lock is integrally formed with the clip.

9. The vacuum cleaner clip of claim 1, further including first and second hose inlets, the first inlet being provided between the first end of the first curvilinear member and the bridge, the second inlet being provided between the second end of the second curvilinear member and the bridge when the second curvilinear member is in the release position.

10. The vacuum cleaner clip of claim 9, wherein the clip has a longitudinal axis passing through the first curvilinear member, the bridge and the second curvilinear member, and a transverse axis passing through the bridge, the first and second inlets being adapted to receive vacuum cleaner hoses in opposite directions, both directions being substantially parallel to the transverse axis.

11. The vacuum cleaner clip of claim 1 further including at least one bracket adapted to attach the clip to a wall.

12. The vacuum cleaner clip of claim 11 including first and second brackets, each bracket including a recess, the recess adapted to receive a fastener for attaching the hose clip to a wall.

13. A vacuum cleaner hose clip adapted to hold first and second vacuum cleaner hose portions together, the clip comprising:

a first arm forming an incomplete loop, the first arm being adapted to partially surround a first hose portion; and a second arm connected to the first arm and forming an incomplete loop, the second arm being adapted to partially surround a second hose portion, the first and second arms forming a hose clip having a substantially "S" shaped configuration.

14. The vacuum cleaner hose clip of claim 13, wherein the first and second arms are integral.

15. The vacuum cleaner hose clip of claim 13, wherein the clip is manufactured from integrally molded resilient plastic.

16. The vacuum cleaner hose clip of claim 13, further including a lock adapted to secure the second arm in a locking position forming a complete loop.

17. The vacuum cleaner hose clip of claim 16 further including a second lock adapted to secure the first arm in a locking position forming a complete loop.

18. The vacuum cleaner hose clip of claim 16, wherein the lock includes first and second mating portions attached to the second arm.

19. The vacuum cleaner hose clip of claim 18, wherein the first portion is a hook at the first end of the second arm, and the second portion is a clasp at a juncture between the first and second arms.

20. The vacuum cleaner hose clip of claim 19 further including at least one bracket adapted to attach the clip to the wall.

21. The vacuum cleaner hose clip of claim 19 further including first and second brackets, each bracket including a recess adapted to receive a fastener for attaching the clip to a wall.

22. A wet/dry vacuum cleaner, comprising:

a tank;

a vacuum source associated with the tank, the vacuum source being adapted to draw matter into the tank;

a hose connected to an inlet of the vacuum source; and a hose clip connected to the hose, the hose clip including first and second arms, the first arm being wrapped around the entire circumference of the hose, the second arm being partially wrapped around the circumference of the hose.

23. The wet/dry vacuum cleaner of claim 22, wherein the hose clip first arm is adapted to move between release and locking positions, the first arm being wrapped completely around the hose when in the locking position, the first arm being wrapped partially around the hose when in the release position.

24. The wet/dry vacuum cleaner of claim 23, wherein the hose clip further includes a lock, the lock being adapted to releasably maintain the first arm in the locking position.

25. The wet/dry vacuum cleaner of claim 24, wherein the hose clip lock includes a mating hook and clasp assembly.

26. The wet/dry vacuum cleaner of claim 25, wherein the first and second arms and lock are integrally formed together.

27. The wet/dry vacuum cleaner of claim 22, wherein the hose clip includes at least one bracket for attaching the hose clip to a wall, the hose being disconnectable from the vacuum cleaner for separate storage using the hose clip.

* * * * *